US005155460A

United States Patent [19]

Huckins et al.

[11] Patent Number: 5,155,460

[45] Date of Patent: Oct. 13, 1992

[54] SWITCH HOUSING WITH MAGNETIC ROLLER PLUNGER

[75] Inventors: Charles M. Huckins, Sherwood; Robert H. Niemeyer, III, Tigard; Keith E. Flint, Portland, all of Oreg.

[73] Assignee: Sentrol, Inc., Portland, Oreg.

[21] Appl. No.: 663,114

[22] Filed: Mar. 1, 1991

[51] Int. Cl.[5] ..... H01H 9/02

[52] U.S. Cl. ..... 335/205; 335/207

[58] Field of Search ..... 335/205-207, 335/151-153

[56] References Cited

U.S. PATENT DOCUMENTS 4,336,518 6/1982 Holce et al. ..... 335/205

*Primary Examiner*—Lincoln Donovan

*Attorney, Agent, or Firm*—Chernoff, Vilhauer, McClung & Stenzel

[57] ABSTRACT

A plunger-operated switch assembly, useful for sensing the presence of a movable object such as a door or window, in which a magnetic reed contact is actuated by a magnet in the form of a disk-like roller plunger, or by a smaller magnet carried in the center of a roller plunger. The roller plunger is located in a cavity defined by a housing and projects through an aperture in a face plate including a flange by which the housing can be mounted recessed in a desired location. The magnetic reed contact is held alongside the cavity containing the roller plunger, so that the housing can be compact. A magnetic electrical conductor lead connected with a magnetic reed is located so as to be effectively within the magnetic field of the actuating magnet when the roller plunger is depressed a small distance so that the magnetic reed switch is actuated by a small movement of the plunger.

27 Claims, 4 Drawing Sheets

SWITCH HOUSING WITH MAGNETIC ROLLER PLUNGER

BACKGROUND OF THE INVENTION

The present invention relates to plunger-operated electrical switches, and particularly to a switch operated by a roller plunger and including a magnetically actuated contact.

Switch assemblies in which a moving body contacts a plunger equipped with a roller, and in which depression of the plunger opens or closes the switch contacts, are well known. One application for such switches is in the field of physical security alarm systems, where sensor switches in intrusion alarm circuits include roller-tipped plungers to be depressed by a moving body such as a door being closed.

For dependability many sensor switch assemblies included in intrusion alarm systems incorporate magnetically actuated reed contacts. For example, Holce U.S. Pat. No. 4,456,897 discloses a plunger-operated switch assembly including a magnetic reed contact. Holce et al. U.S. Pat. No. 4,336,518 discloses a switch assembly including a roller which moves a sliding plunger carrying a magnet which actuates a magnetic reed contact. The magnet used in such plunger switch assemblies in the past has typically been a small bar magnet carried in the plunger and having an axis of polarity aligned in the direction of reciprocal movement of the plunger, in order to achieve a reliable actuation of the reed switch at a desired position of the plunger. The arrangement of parts within such switch assemblies has resulted, however, in switch assemblies typically having a length of at least 1 ½ inches. The housing of such a switch assembly must be long enough to contain a roller, a plunger, a plunger spring, and an encapsulated magnetic reed contact located where a magnet carried in the plunger can move far enough along the reed switch capsule to operate the magnetic reed contact. In some such switch assemblies separate parts of a housing must be glued, welded, or otherwise fastened together contributing to a significant labor item in the cost of manufacture.

A disadvantage of such previously available plunger switch assemblies is that a cavity deep enough to receive the switch assembly must be provided, in order to mount the switch assembly unobtrusively for use as part of an intrusion detection sensor circuit. It is desirable to be able to fit the switch assembly entirely within the frame surrounding a doorway or window opening, because in some cases it may be difficult to form a cavity to receive the switch assembly in structural materials surrounding a doorway or window frame. The larger the cavity which must be formed to receive such a switch assembly, the longer it usually takes to make such a cavity. As a result, if a smaller cavity is required less time is required for installation of such a switch assembly, and a security system sensor circuit can be installed more quickly and less expensively. It is therefore desired to have a plunger-operated switch assembly which is compact enough to be mounted flush within a small cavity, yet which has the reliability available from magnetically actuated reed switches.

Manufacture of some previously available switch assemblies incorporating magnetic reed contacts has required installation of the magnetic reed contacts in a housing in a particular orientation, as well as requiring adjustment of the position of a biasing magnet, helper magnet, or actuating magnet, either during assembly or during installation of such a switch assembly. Such orientation or adjustment steps also require a certain amount of time and thereby increase the cost of manufacture or installation of such switch assemblies.

It is therefore desired to provide an inexpensive switch assembly with a roller plunger, which has the reliability of a magnetic reed contact, which is contained in a housing small enough to be installed in a small cavity, and which can be manufactured using readily available inexpensive magnetic reed contacts and actuating magnets and without requiring separate steps to orient and adjust the location of magnetic reed contacts, biasing magnets or helper magnets.

SUMMARY OF THE INVENTION

The present invention provides a plunger-operated switch assembly including a compact housing which holds an encapsulated magnetic reed contact and a roller-type plunger movable alongside the magnetic reed contact and in which the roller plunger may either simply be a permanent magnet or may carry a permanent magnet centrally located within a larger-diameter roller, where it is moved with the roller, regardless of rotation of the roller, to operate the magnetic reed contact in response to depression of the roller plunger to a sufficient distance. Such a permanent magnet is preferably cylindrical and polarized along the central axis of the roller so that radial movement of the roller plunger changes the magnetic field in the vicinity of a magnetic reed contact held in the housing to operate the magnetic reed contact in response to the position of the plunger, regardless of its rotation.

In one embodiment of the invention the roller plunger is a small disk-like, generally cylindrical magnet whose poles are on opposite generally circular faces or ends of the magnet.

In a preferred embodiment of the invention a unitary molded roller defines an actuating magnet receptacle, and an actuating magnet of resiliently compressible permanently magnetizable material is held in the receptacle by an interference fit.

In a preferred embodiment of the invention a housing incorporates a mounting flange, defines cavities holding the magnetic reed contact, the roller plunger and a biasing spring, and is molded of plastic material as a single piece requiring no chemical or sonic welding during assembly.

Also, in a preferred embodiment of the invention the roller plunger can be installed appropriately within the body of the housing by temporary elastic deformation of the housing or the roller plunger, after which the housing properly retains the roller plunger.

In one embodiment of the invention a magnetic contact lead may be placed where it is advantageously located with respect to the field of the actuating magnet when the roller plunger is depressed, so that a small actuating magnet can control the operation of the magnetic reed contact in response to a small movement of the roller plunger.

It is therefore a principal object of the present invention to provide an improved plunger-operated switch assembly.

It is another important object of the present invention to provide such a switch assembly which is compact in size, so that a cavity of adequate size for recessed installation of the switch assembly can be prepared in a relatively short time.

It is a further object of the present invention to provide a plunger-operated switch assembly which is reliable yet low in cost for parts and labor.

It is a principal feature of one embodiment of the present invention that it provides a plunger-operated switch including a plunger in the form of a roller and which carries an actuating magnet located centrally within the roller.

It is another important feature of the present invention that it provides a switch assembly in which a magnetic reed contact is located alongside a roller plunger, within a housing, and that a magnetic conductor lead attached to a magnetic reed is located in such a position with respect to the magnetic field of the roller plunger as to cause the magnetic reed contact to operate when the roller plunger is depressed.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
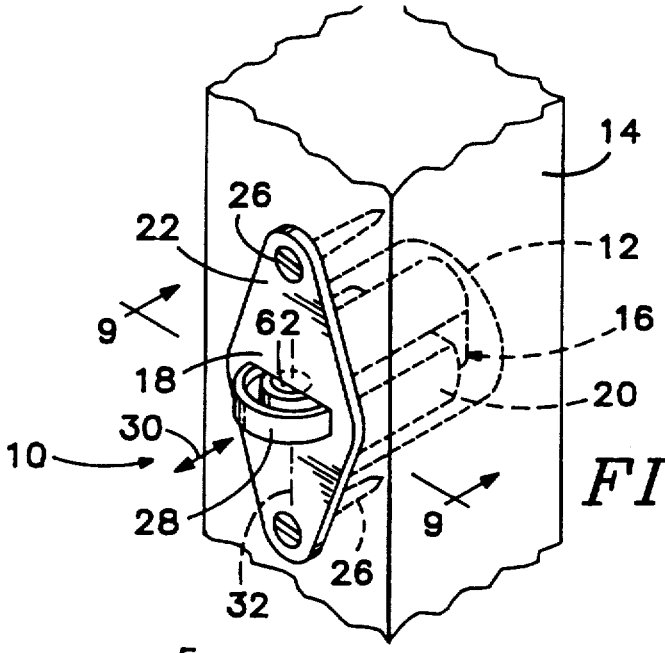
FIG. 1 is a perspective view showing a plunger-operated switch according to the present invention mounted in a typical installation as in a doorjamb.

Referring now to the drawings which form a part of the disclosure herein, in FIG. 1, a switch assembly 10 embodying the present invention is shown mounted in a cavity 12 defined in a frame member 14, which may be a portion of a wooden doorway frame, window casing, or the like.

Figure 2:
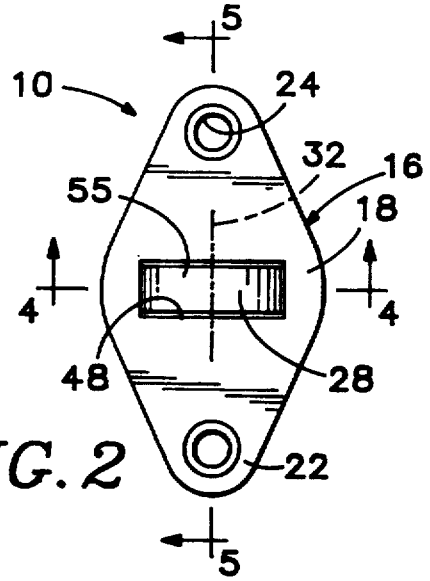
FIG. 2 is a front view of the switch assembly shown in FIG. 1.

The switch assembly 10 includes a housing 16 having a face member 18 which extends beyond a body 20 as a flange 22, defining holes 24 (see FIGS. 2 and 3) to receive fasteners such as screws 26.

Contained partially within the body 20 and protruding outwardly beyond the surface of the face member 18 is a plunger 28 in the form of a roller which may be moved deeper into the body 20 and can thereafter return to the position shown in FIG. 1, as indicated by the arrow 30. At the same time, the roller plunger 28 is free to rotate about its central longitudinal axis 32 when encountered, for example, by the edge of a door being closed within the doorway of which the frame member 14 may be a part.

Referring now also to FIGS. 4-9 of the drawings, the body 20 may be of molded plastic, and defines a plunger cavity 34. The plunger cavity 34 provides room for the roller plunger 28 to move reciprocally as indicated by the arrow 30. A plunger spring 36, such as a small helical coil spring which need only be strong enough to move the roller plunger 28 reliably, is located within the plunger cavity 34, with one end extending within a spring well 38. A spring retainer 40 is located at the opposite end of the plunger spring 36. The spring retainer 40 acts as a follower against the roller plunger 28, and has a concave central portion 42 and a pair of end portions 44 which extend generally parallel with the face member 18. A locator stem 46 extends within the end of the helical coil plunger spring 36, so that the spring retainer 40 holds the plunger spring 36 properly oriented despite either reciprocal or rotational movement of the roller plunger 28 within the plunger cavity 34. The spring retainer 40 is preferably of molded plastic material, preferably having a low coefficient of friction with respect to the roller plunger 28, so that the roller plunger 28 can easily rotate, as well as be depressed.

The roller plunger 28 protrudes from the face member 18 through a plunger aperture 48 defined in part by a pair of concave, inwardly sloping surfaces 50 which are spaced closer together than the diameter 52 of the roller plunger 28. For example, the roller plunger 28 may protrude by a distance 53 of 0.225-0.275 inch when the diameter 52 is 0.6 inch. Because of the somewhat resilient material of which the housing 16 is made, however, the roller plunger 28 can be forced into the plunger cavity 34 by temporarily elastically displacing the material defining the surfaces 50, which then resiliently return to positions in which they prevent the roller plunger 28 from being expelled from the plunger cavity by the force of the plunger spring 36. The depth of the plunger cavity 34 and the length of the plunger spring 36 are sufficient to permit the roller plunger 28 to be depressed into the plunger cavity far enough not to protrude beyond the face member 18.

The roller plunger 28 is molded of plastic, preferably of a glass filled polyester such as Valox TM plastic which is hard, long-wearing, and dimensionally stable. The roller plunger 28 may include an annular rim portion 54 having a generally cylindrical outer surface 56, an annular hub portion 58 located centrally within the area defined by the rim portion 54, and a web portion 60 interconnecting the rim portion 54 with the hub portion 58, as may be seen best in FIG. 9. The overall shape of the roller plunger 28 is generally cylindrical, with a cylinder length significantly less than the diameter 52, so that the roller plunger 28 may be said to be disk-like.

An actuating magnet 62 is held within a magnet receptacle 64 defined centrally within the hub 58. The magnet receptacle 64 may be generally cylindrical, but preferably is slightly tapered outwardly toward each side of the roller plunger 28, from a medially-located, reduced area portion having a slightly reduced diameter 66.

The actuating magnet 62 is preferably made of a resiliently compressible material which may be permanently magnetized. For example, material such as a flexible magnetic material manufactured by 3M Company, and sold under the trademark Plastiform® B-1030, which has an energy product of 1.4×10 Gauss-Oersted is suitable. It is magnetized with its north-south polar axis extending in a direction parallel with, and preferably coincident with, the central axis 32 of the plunger roller 28. The actuating magnet 62 may be cut from a sheet of such flexible magnetic material in a form of a cylinder having a diameter somewhat greater than the reduced diameter 66, so that the actuating magnet 62 can be forced into the magnet receptacle 64 with an interference fit which will securely hold the actuating magnet 62 within the magnet receptacle 64 as a result of friction between the actuating magnet 62 and the interior surface of the magnet receptacle 64. The diameter 52 may, for example, be approximately 0.60 inch, and the reduced portion diameter 66 within the roller plunger 28 may, for example, be about 0.180 inch, while the diameter of the actuating magnet 62 may be about 3/16ths inch, providing an interference of about 0.006 inch.

Figure 10:
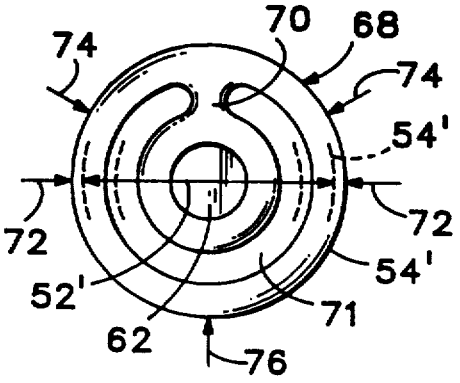
FIG. 10 is a side view of an alternative plunger roller for use in the switch assembly according to the present invention.
Figure 4:
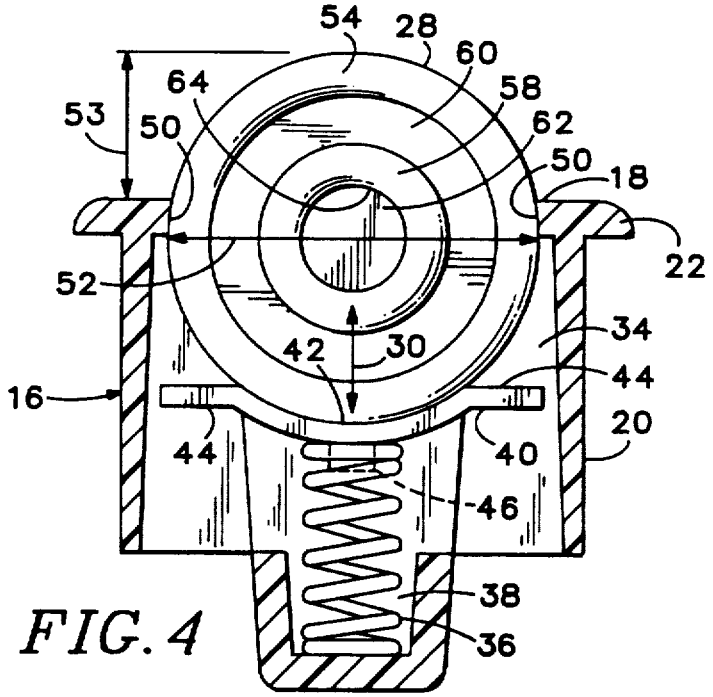
FIG. 4 is a sectional view, taken along line 4—4 of FIG. 2, at an enlarged scale.

A roller plunger 68, shown in FIG. 10, differs from the roller plunger 28 in that its rim portion 54' and hub portion 58' are not connected with one another except by a radial spoke 70, leaving an annular slot 71 so that the rim portion 54' may be compressed diametrically by sufficient pressure, applied, for example, at the locations indicated by the arrows 72. When the rim portion 54' is displaced to the positions indicated by broken lines in FIG. 10, the diameter 52' of the roller plunger 68 is small enough to fit through the plunger aperture 48 of the housing 16 without deforming the material of the housing 16. Thereafter, the rim portion 54' elastically returns to its normal shape, and the surfaces 50 can retain the roller plunger 68 within the plunger cavity 34 by contacting the roller plunger 68 as indicated by the arrows 74 in FIG. 10, even though the spring retainer 40 pushes upon the rim portion 54' at the position indicated by the arrow 76. While the roller plunger 68 will be free to rotate, the forces exerted by the surfaces 50 and the plunger spring 36 will not be sufficient to deform the rim portion 54' from a generally circular configuration.

Figure 3:
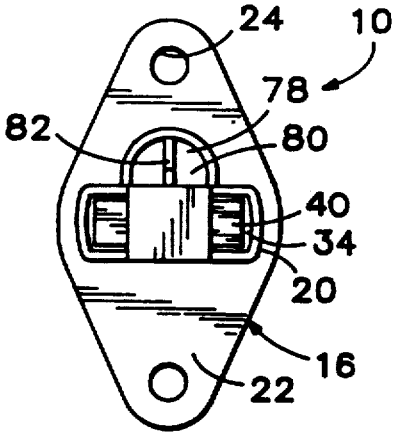
FIG. 3 is a rear elevational view of the switch assembly shown in FIGS. 1 and 2.
Figure 9:
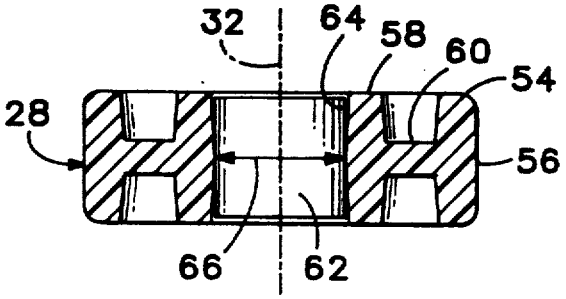
FIG. 9 is a sectional view of the plunger roller shown in FIGS. 1-6, taken along the line 9—9 of FIG. 1.
Figure 5:
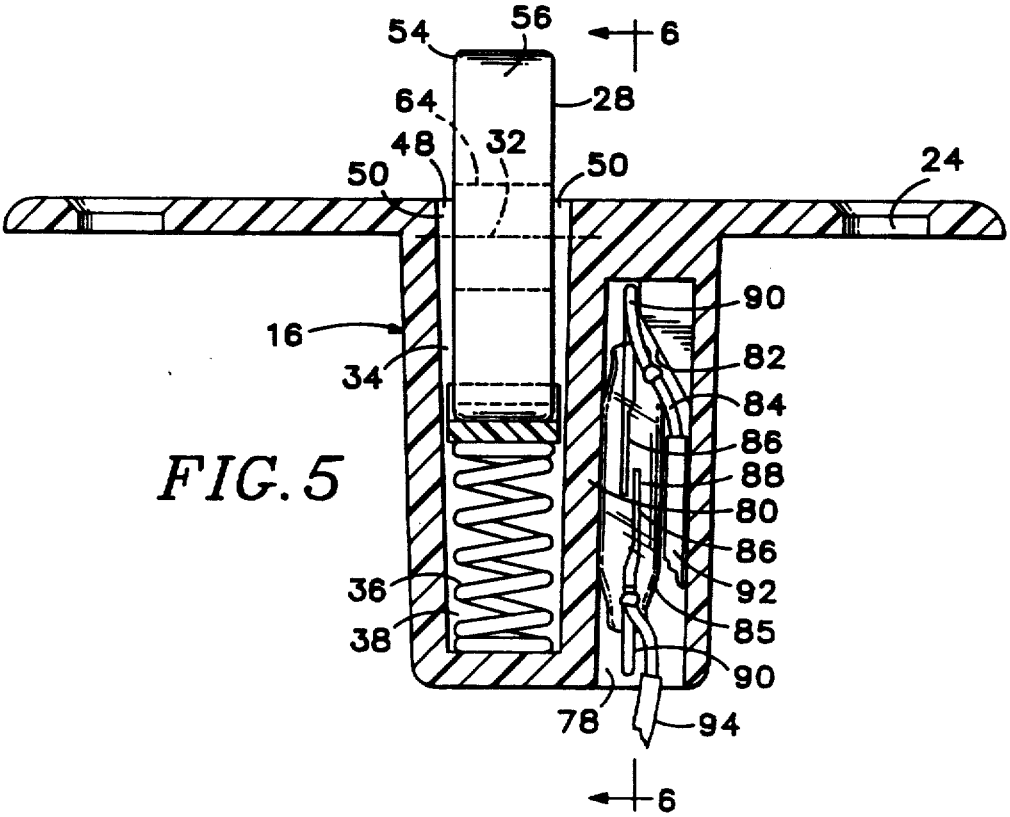
FIG. 5 is a sectional view, taken along line 5—5 of FIG. 2, at an enlarged scale.
Figure 6:
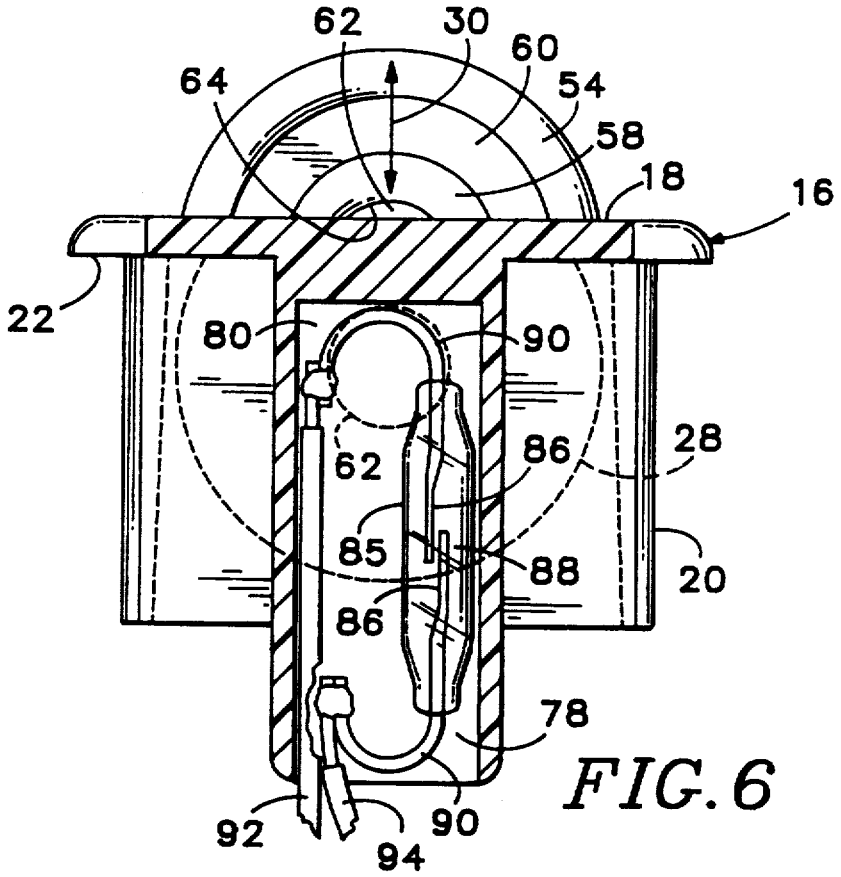
FIG. 6 is a sectional view of the switch assembly shown in FIG. 2, at an enlarged scale, taken along the line 6—6 of FIG. 5.
Figure 7:
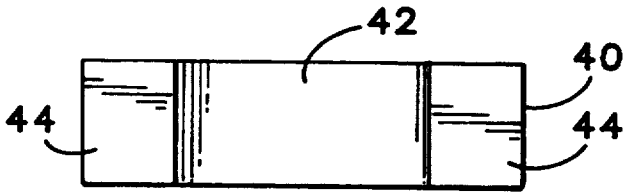
FIG. 7 is a top plan view of the spring retainer shown in FIGS. 4 and 5.
Figure 8:
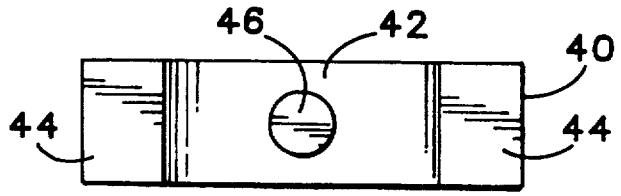
FIG. 8 is a bottom plan view of the spring retainer shown in FIGS. 4, 5, and 7.

Referring now to FIGS. 3, 5, and 6, in particular, the housing 16 defines a switch cavity 78 having generally a semicylindrical shape, located alongside a dividing wall 80 defining one side of the plunger cavity 34. A switch locator 82, a small web, has a margin surface sloped toward the dividing wall 80, and a magnetic reed contact 84, preferably encapsulated in a small glass capsule 85, is located within the switch cavity 78, where the switch locator 82 keeps it aligned closely alongside the dividing wall 80, as may be seen in FIG. 5.

The magnetic reed contact 84 is preferably of the center contact type, with a somewhat flexible magnetic reed 86 mounted in each end of the glass capsule. The reeds 86 overlap each other in a central portion 88 of the reed contact 84, as a "Form A" reed contact, in which the reeds 86 are physically separated from one another in the absence of a sufficiently strong magnetic field. When subjected to a sufficient magnetic flux density the reeds 86 are attracted to each other and flex toward each other, coming into physical and electrical contact with each other so that the switch changes from an open to a closed state, as is well known.

A magnetic conductor lead 90, which is a continuation of the material of the reed 86, extends from each reed 86 outside the capsule 85. The conductor leads 90 are bent into a U-shaped configuration, so that they extend toward one another at each end of the capsule 85. This may be accomplished easily by trimming each of the conductor leads 90 so that the overall length of the capsule 85 and the conductor leads 90 is as desired, after which the conductor leads 90 may be bent around pins of a forming jig, so that the conductor leads 90 lie, in their curved configurations, in a single plane as shown in FIGS. 5 and 6.

Electrical conductors 92, 94 may typically be of insulated copper wire, used to interconnect the switch assembly 10 with a sensor circuit with an alarm system, for example. The electrical conductors 92, 94 are connected to the conductor leads 90, as by soldering, so that the electrical conductors 92, 94 extend in the same direction away from the capsule 85, as shown in FIGS. 5 and 6. The switch guide 82 requires the magnetic reed contact 84 to lie alongside the dividing wall 80 inside the switch cavity 78, where the magnetic reed contact 84 can be secured by use of a suitable potting material or adhesive. With the magnetic reed contact 84 in the position shown in FIGS. 5 and 6, when the roller plunger 28 is depressed to the position shown in broken line in FIG. 6, the actuating magnet 62 is located alongside the conductor lead 90 at the end of the magnetic reed contact 84 closer to the face member 18, and the conductor lead 90 is within the magnetic field of the actuating magnet 62, which induces magnetic flux within the conductor lead 90 and magnetic reeds 86, closing the magnetic reed contact 84 electrically. With the magnetic reed contact 84 in this position, there is only a small distance between it and the closer face of the actuating magnet 62, when the roller plunger 28 is depressed. For example, the distance from the closer face of the actuating magnet to the center line of the conductor lead 90 may be in the range of 0.082–0.105 inch, including the distance by which the face of the actuating magnet 62 is depressed beneath the surface of the hub of the roller plunger 28, the thickness of the dividing wall 80, and the radius of the capsule 85. As a result, the magnetic flux density in the conductor lead 90 closer to the face member 18 is sufficient to cause magnetic actuation of the magnetic reed contact 84 when the plunger roller 28 is depressed, and yet decreases sufficiently to result in separation of the reeds 86 when the roller plunger 28 is returned to its protruding position by the plunger spring 36.

Thus, when the roller plunger 28 protrudes as shown in solid line in FIG. 6 the actuating magnet 62 is displaced far enough from the magnetic lead 90 and the central portion 88 of the magnetic reed contact 84 that an insufficient magnetic field density is induced in the reeds 86, and they remain separated from each other so that the magnetic reed contact 84 is electrically open.

It will be appreciated that the use of a readily available magnetic reed contact 84 of the center-contact type, (such as the GR400 magnetic reed available from Standex Electronics of Kent, England, and Cincinnati, Ohio, rated at 15–20 ampere-turns) will provide significant savings in labor over the use of a similarly-rated magnetic reed contact which is not of the center-contact design, since the reed contacts will not need to be oriented in a particular direction during the process of attachment of the electrical conductors 92, 94. The use of a magnetic reed contact having a short capsule 85 contributes to the ability to manufacture a switch assembly 10 compact enough to fit within a small cavity 12, having a diameter, for example, of 0.75 inch and depth of only slightly more than about 0.75 inch.

Figure 11:
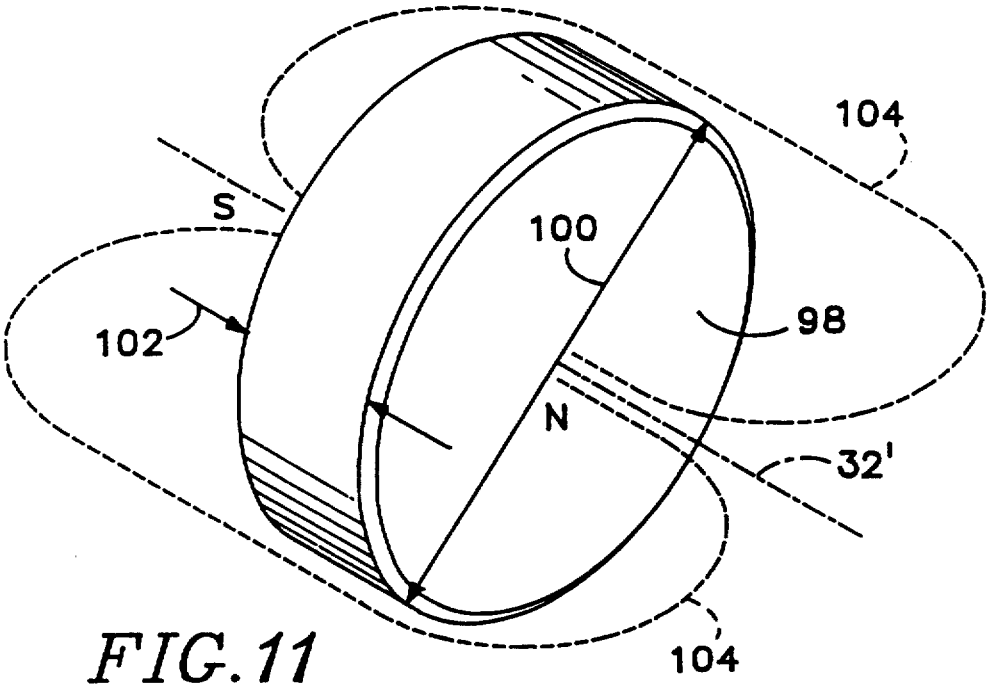
FIG. 11 is a perspective view of another alternative roller plunger for use in the switch assembly according to the invention.

Referring now also to FIG. 11, a roller plunger 98 is a small disk-like, generally cylindrical magnet having a large enough diameter 100 to function adequately as a roller, and having a large enough thickness 102 to be permanently magnetized with its north-south axis of polarity extending along the central axis 32' of its generally cylindrical shape. A readily available disk-like ceramic magnet with a diameter of 1.5 inch and a thickness of 0.25 inch, such as those used to hold notes in place on refrigerators, serves as a suitable magnetic roller plunger 98 and is very inexpensive, as well as being hard and durable enough to be practical in such use. Use of such a ceramic magnet as the entire roller plunger 98 results in a relative large magnetic field, however, as indicated by the broken lines 104 representing lines of flux. For best performance a magnetic reed contact used with the roller plunger 98 should have a suitable small operating differential, or hysteresis, and may be less sensitive than a magnetic reed contact 84 intended to be actuated by the smaller magnet 62 shown in the embodiments of the invention depicted in FIGS. 1-10. For example, a magnetic reed contact 106 rated at 25-30 ampere turns is satisfactory for use with the roller plunger 98.

Figure 12:
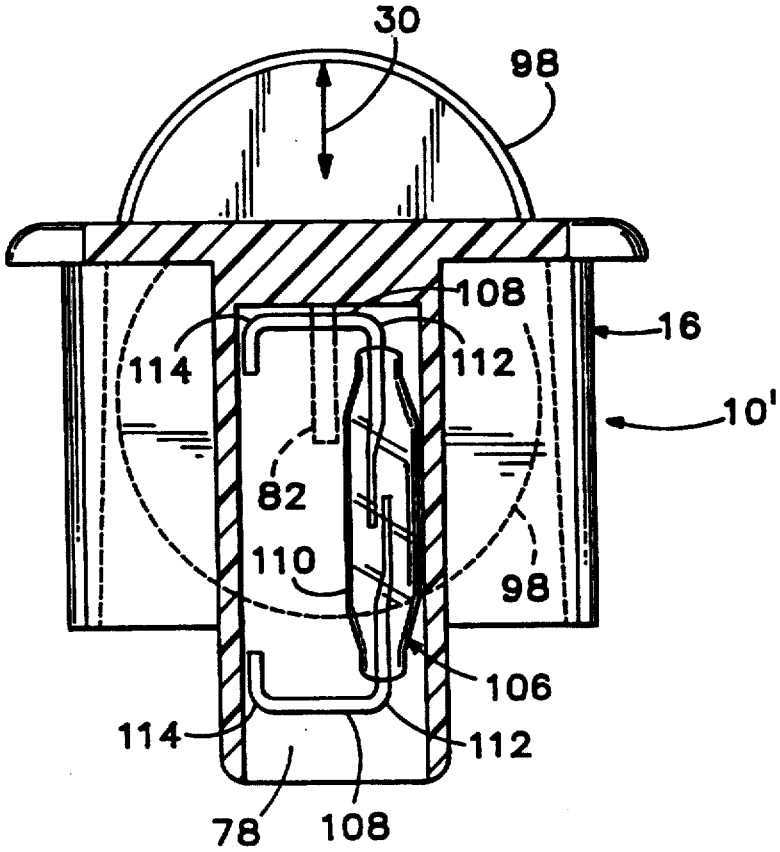
FIG. 12 is a view similar to that of FIG. 6, showing an alternative configuration of a magnetic lead for a magnetic reed contact incorporated in a switch assembly according to the invention.

A further refinement of some benefit, particularly in a switch assembly 10', which is similar to the switch assembly 10 but incorporates the ceramic magnetic roller plunger 98, and also of benefit in a switch assembly 10 of the invention as shown in FIGS. 1-10, is a magnetic reed contact 106 incorporating magnetic reed leads 108 which extend substantially perpendicularly away from the respective ends of the capsule 110, with sharp bends defined in the leads 108 at 112 and 114, as shown in FIG. 12. This configuration and placement of the magnet leads 108 may be accomplished by machine, further reducing labor costs associated with manufacture of a switch assembly according to the present invention. More importantly, however, this configuration of the magnetic leads 108 provides improved definition and production repeatability of the position of depression of the roller plunger 98, with respect to the housing 16, at which the magnetic reed contact 106 operates magnetically. Also, this configuration of the reed leads 108 provides consistent location of the magnetic reed contact 106 within the switch cavity 78, by providing a close fit relative to the interior of the switch cavity 78 and the switch guide 82.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A housing for a magnetic reed contact, comprising:

(a) a roller plunger having a central axis and extending radially about said central axis, said roller plunger including a permanent magnet;

(b) body means for holding said roller plunger and permitting rotation and a predetermined amount of reciprocal movement thereof radially with respect to said central axis while said roller plunger remains within said body means;

(c) biasing means, associated with said body means, for urging said roller plunger radially toward a first position with respect to said housing; and (d) means for holding a magnetic read contact in a predetermined location with respect to said body means.

2. The housing of claim 1 wherein said permanent magnet is smaller than said roller plunger and said roller plunger includes magnet receptacle means for holding said permanent magnet, said magnet receptacle means including an opening extending coaxially through said roller plunger.

3. The housing of claim 1 wherein said roller plunger consists of a generally cylindrical disk-shaped permanent magnet.

4. The housing of claim 1, including a face member defining a roller aperture, a portion of said roller plunger protruding radially outward through said roller aperture when said roller plunger is in said first position, but said roller aperture being small enough to retain said plunger roller in said body means despite force applied by said biasing means.

5. The housing of claim 4 wherein said face member is resilient and said roller aperture is large enough to admit said roller plunger to be forced through said roller aperture into said body means.

6. The housing of claim 4, said roller plunger being resiliently compressible to a small enough size to be inserted through said roller aperture into said body means.

7. The housing of claim 6, said roller plunger including an annular outer rim portion and a hub portion, said hub portion including magnet receptacle means for holding said permanent magnet, and said outer rim and said hub portion being interconnected with each other by a web portion.

8. A housing for a magnetic reed contact, comprising:

(a) a roller plunger extending radially about a central axis, said roller plunger including magnet receptacle means for holding a permanent magnet centrally within said roller plunger;

(b) body means for holding said roller plunger and permitting reciprocal radial movement thereof;

(c) biasing means associated with said body means for urging said roller plunger toward a first position with respect to said housing; and (d) means associated with said body means for holding a magnetic reed contact in a predetermined location therein.

9. The housing of claim 8 wherein said magnet receptacle means is an opening extending coaxially through said roller plunger.

10. The housing of claim 8 including a face member defining a roller aperture, a portion of said roller plunger protruding radially outward through said roller aperture when said roller plunger is in said first position, but said roller aperture being small enough to retain said roller plunger in said body means despite force applied by said biasing means.

11. The housing of claim 10 wherein said face member includes flange means for establishing a mounting position for said housing.

12. The housing of claim 10 wherein said face member is resilient and said roller aperture is large enough to admit said roller plunger to be forced through said roller aperture into said body means.

13. The housing of claim 10, said roller plunger being resiliently compressible to a small enough size to be inserted through said roller aperture into said body means.

14. The housing of claim 13, said roller plunger including an annular outer rim portion and a hub portion defining said magnet receptacle means, said outer rim and said hub portion being interconnected with each other by a web portion.

15. The housing of claim 8 wherein said magnet receptacle means is an opening extending coaxially through said roller plunger, said opening including a reduced portion for helping to hold a magnet in said magnet receptacle means.

16. A switch assembly, comprising:

(a) a housing;

(b) a magnetic reed contact held in the housing;

(c) a roller plunger in the shape of a short cylinder having a central longitudinal axis, said plunger being reciprocally movable radially within said housing between a first position in which a portion of said roller plunger protrudes radially from said housing and a second position in which said roller plunger is depressed further into said housing than said first position, and said roller plunger including a magnet defining an axis of polarity parallel with the central longitudinal axis of said cylinder, said magnetic reed contact being held in said housing in such a position with respect to said roller plunger that when said roller plunger moves between said first position and said second position said magnetic reed contact is thereby changed between respective states of activation; and (d) means for biasing said roller plunger toward said first position.

17. The switch assembly of claim 16 wherein said roller consists of a generally cylindrical permanent magnet.

18. The switch assembly of claim 16 wherein said magnetic reed contact includes a pair of magnetic reeds oriented generally parallel with the direction in which said roller plunger is reciprocally movable between said first and second positions.

19. The switch assembly of claim 16 wherein said housing defines a cavity containing said means for biasing said plunger and said housing further defines an aperture communicating with the interior of said cavity, said aperture being large enough to admit said plunger to be forced into said cavity and to be reciprocally movable therein between said first and second positions, but said plunger being too large to pass through said aperture thereafter in response to said means for biasing.

20. A plunger-controlled switch assembly for use in an electrical circuit, comprising:

(a) a disk-like roller plunger having a central axis;

(b) a housing including a face member and body means defining a plunger cavity extending rearwardly from said face member for containing said roller plunger movably therein, said roller plunger being held in said plunger cavity and being movable reciprocally therein, in a radial direction with respect to said central axis, and said face member defining a plunger aperture and a portion of said roller plunger protruding forwardly through said plunger aperture when said roller plunger is in a first position;

(c) biasing means associated with said body for urging said roller plunger toward said first position;

(d) an actuating magnet located centrally in said roller plunger;

(e) a magnetic reed contact held in said body proximate said plunger cavity, said reed contact being in a first predetermined state in response to said roller plunger being in said first position and being changed to a second predetermined state in response to depression of said roller plunger by at least a predetermined distance from said first position.

21. The switch assembly of claim 20 wherein said magnetic reed contact is magnetically unactuated when said plunger roller is in said first position and is magnetically actuated when said roller plunger is depressed into said roller cavity at least said predetermined distance from said first position.

22. The switch assembly of claim 20, including means defining a switch cavity for holding said reed contact proximate said roller cavity.

23. The switch assembly of claim 22, including a dividing wall located between said roller cavity and said switch cavity and separating them from each other, said switch cavity including switch locator means for holding said reed contact closely against said dividing wall.

24. The switch assembly of claim 20 wherein said magnetic reed contact includes an elongate capsule supporting and containing a pair of flexible elongate magnetic reeds extending toward each other from opposite ends of said elongate capsule and overlapping each other in a central location within said capsule, said reed contact also having a respective magnetically permeable electrical conductor lead extending longitudinally outward from each end of said capsule, at least one said conductor lead extending arcuately back toward said capsule.

25. The switch assembly of claim 20 wherein said roller plunger defines a central opening and said actuating magnet is of resiliently compressible permanent magnet material and is held in said central opening by an interference fit.

26. The switch assembly of claim 25 wherein said central opening extends axially through said roller plunger and includes a reduced area portion for providing said interference fit to hold said actuating magnet.

27. The switch assembly of claim 20 wherein said magnetic reed contact includes an elongate capsule supporting and containing a pair of flexible elongate magnetic reeds extending toward each other from opposite ends of said elongate capsule and overlapping each other in a central location within said capsule, said reed contact also having a respective magnetically permeable electrical conductor lead extending longitudinally outward from each end of said capsule, at least one said conductor lead extending outward a predetermined distance from said capsule and thence extending radially alongside said roller plunger and parallel with said face member.

* * * * *

UNITED STATES PATENT AND TRADEMARK OFFICE

CERTIFICATE OF CORRECTION

PATENT NO. : 5,155,460

DATED : October 13, 1992

INVENTOR(S) : Charles M. Huckins et al.

It is certified that error appears in the above-identified patent and that said Letters Patent is hereby corrected as shown below:

| | | |
|---|---|---|
| COL. 5 | Line 6 | Delete "1.4 x 10" and insert --1.4 x $10^6$--. |
| COL. 8 | Line 6 | Delete "read" and insert --reed--. |
| COL. 9 | Line 37 | After "roller" insert --plunger--. |
| COL. 10 | Line 17 | Delete "plunger roller" and insert --roller plunger--. |

Signed and Sealed this

Twenty-sixth Day of October, 1993

*Attest:*

Bruce Lehman

BRUCE LEHMAN

*Attesting Officer*

*Commissioner of Patents and Trademarks*

US005155460A

REEXAMINATION CERTIFICATE (2580th)

United States Patent [19]

[11] B1 5,155,460

Huckins et al.

[45] Certificate Issued May 16, 1995

[54] SWITCH HOUSING WITH MAGNETIC ROLLER PLUNGER

[75] Inventors: Charles M. Huckins, Sherwood; Robert H. Niemeyer, III, Tigard; Keith E. Flint, Portland, all of Oreg.

[73] Assignee: Sentrol, Inc., Portland, Oreg.

Reexamination Request:
No. 90/003,432, May 13, 1994

Reexamination Certificate for:

| | |
|---|---|
| Patent No.: | **5,155,460** |
| Issued: | **Oct. 13, 1992** |
| Appl. No.: | **663,114** |
| Filed: | **Mar. 1, 1991** |

Certificate of Correction issued Oct. 26, 1993.

[51] Int. Cl.[6] ..... H01H 9/02
[52] U.S. Cl. ..... 335/205; 335/207
[58] Field of Search ..... 335/205, 206, 207, 151, 335/152, 153

[56] References Cited

U.S. PATENT DOCUMENTS

| | | | |
|---|---|---|---|
| 2,953,662 | 9/1960 | Batt | 200/91 |
| 3,240,891 | 3/1966 | Bergey | 200/61.46 |
| 3,249,713 | 5/1966 | Briggs | 200/87 |
| 3,250,871 | 5/1966 | Wigger | 200/61.46 |
| 3,773,998 | 11/1973 | Seeger, Jr. et al. | 200/159 B |
| 4,336,518 | 11/1980 | Holce et al. | 335/205 |
| 4,939,324 | 7/1990 | English et al. | 200/345 |

*Primary Examiner*—Lincoln Donovan

[57] ABSTRACT

A plunger-operated switch assembly, useful for sensing the presence of a movable object such as a door or window, in which a magnetic reed contact is actuated by a magnet in the form of a disk-like roller plunger, or by a smaller magnet carried in the center of a roller plunger. The roller plunger is located in a cavity defined by a housing and projects through an aperture in a face plate including a flange by which the housing can be mounted recessed in a desired location. The magnetic reed contact is held alongside the cavity containing the roller plunger, so that the housing can be compact. A magnetic electrical conductor lead connected with a magnetic reed is located so as to be effectively within the magnetic field of the actuating magnet when the roller plunger is depressed a small distance so that the magnetic reed switch is actuated by a small movement of the plunger.

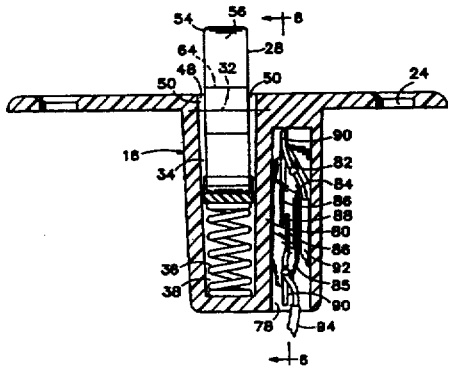

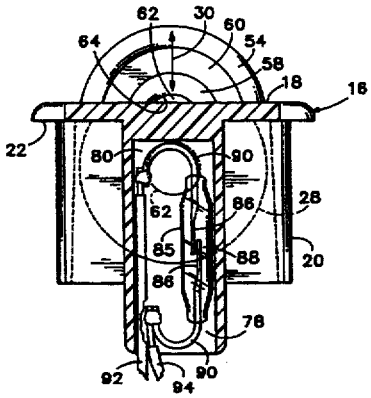

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8–27 is confirmed.

Claim 1 is determined to be patentable as amended.

Claims 2–7, dependent on an amended claim, are determined to be patentable.

1. A housing for a magnetic reed contact, comprising:

a roller plunger having a central axis and extending radially about said central axis, said roller plunger including a permanent magnet *having a magnetic field with a north-south axis of polarity positioned to extend in a direction transverse to said radial extension of said roller plunger;* body means for holding said roller plunger and permitting rotation and a predetermined amount of reciprocal movement thereof radially with respect to said central axis while said roller plunger remains within said body means;

biasing means, associated with said body means, for urging said roller plunger radially toward a first position with respect to said housing;

means for holding a magnetic reed contact in a predetermined location with respect to said body means, *said position of said north-south axis of polarity causing said magnetic field to change said magnetic reed from a first state to a second state as said roller plunger reaches said first position, irrespective of any rotation of said roller plunger about said central axis.*

* * * * *